United States Patent [19]

Henley

[11] Patent Number: 4,683,452

[45] Date of Patent: Jul. 28, 1987

[54] BI-STABLE ELECTROMAGNETIC ACTUATOR

[75] Inventor: Lester P. Henley, Stickney, Ill.

[73] Assignee: Regdon Solenoid, Inc., Brookfield, Ill.

[21] Appl. No.: 879,894

[22] Filed: Jun. 30, 1986

[51] Int. Cl.[4] ..... H01F 7/08

[52] U.S. Cl. ..... 335/234; 335/238

[58] Field of Search ..... 335/229, 230, 234, 236, 335/238

[56] References Cited

U.S. PATENT DOCUMENTS

| | | | |
|---|---|---|---|
| 2,915,681 | 12/1959 | Troy | 317/123 |
| 2,999,192 | 9/1961 | Lambert | 317/191 |
| 3,022,450 | 2/1962 | Chase, Jr. | 317/123 |
| 3,040,217 | 6/1962 | Conrad | 317/172 |
| 3,420,492 | 1/1969 | Ray | 335/234 X |
| 3,683,239 | 8/1972 | Sturman | 335/234 X |
| 3,693,122 | 9/1972 | Willard | 335/174 |
| 3,755,766 | 8/1973 | Read, Jr. | 335/229 |
| 3,792,390 | 2/1974 | Boyd | 335/234 X |
| 3,944,957 | 3/1976 | Kotos et al. | 335/174 |
| 4,072,918 | 2/1978 | Read, Jr. | 335/236 |
| 4,635,016 | 1/1987 | Guery et al. | 335/230 |

*Primary Examiner*—George Harris

*Attorney, Agent, or Firm*—Neuman, Williams, Anderson & Olson

[57] ABSTRACT

An improved bi-stable electromagnetic actuator is provided having an armature linkage moveable between two stable positions either manually or through the application of an appropriate electrical pulse. The actuator includes a permanent magnet which maintains the actuator armature in a first stable position. It also includes a coil which reduces the magnetic flux used to restrain the armature and allows a compression spring to advance the armature to a second stabled position. In moving from the first to the second positions, the armature engages a stop on the linkage and drives the linkage in the same direction. The linkage, thus, transmits the mechanical action of the armature. The user may manually advance the linkage from the first to the second stable position. This linkage includes a rod of magnetically impermeable material in sliding engagement with the armature and a sleeve disposed around this rod at one end of the rod. This sleeve is made from soft magnetic material. The sleeve always lies within the magnetic field created by the permanent magnet. This allows the permanent magnet to pull the sleeve and, accordingly, the linkage in the direction of the permanent magnet and in abutting relation with the armature.

6 Claims, 4 Drawing Figures

BI-STABLE ELECTROMAGNETIC ACTUATOR

BACKGROUND OF THE INVENTION

1. Field of the Invention

The present invention relates generally to electromagnetic actuators and, more specifically, to electromagnetic actuators having an armature linkage movable between two stable positions either manually or through the application of an appropriate electrical pulse.

2. Description of the Prior Art

The present invention is an improvement over U.S. Pat. No. 4,072,918 to R. A. Read, Jr., issued Feb. 7, 1978. That patent discloses a bi-stable electromagnetic actuator which, like all electromagnetic actuators, converts electrical pulses into mechanical action. Specifically, the actuator disclosed includes an armature and a linkage which transmits the mechanical action of the armature. The armature and linkage move between two locations and a permanent magnet maintains the armature at one location, thereby reducing the power consumption of the actuator. In addition, the actuator includes a coil which, upon application of an appropriate pulse, reduces the net flux through the armature and allows a spring to overcome the resulting reduced magnetic force and thereby to move the armature and the linkage. The armature moves in one direction in response to the force exerted by the spring, and in the opposite direction in response to either a force applied manually to the linkage or by a magnetic force applied by the actuator coil.

Many applications require that this type of actuator allow the user to manually advance the linkage in the direction in which the spring would advance the armature upon actuation, without application of an electrical impulse to the coil. Thus, as an initial consideration, the linkage should be movable apart from the armature. In addition, in instances where the armature moves the linkage, it should engage the linkage without any "hammering" action which may damage the parts and/or produce metallic debris.

The bi-stable electromagnetic actuator of the present invention allows a user to manually control the armature linkage and move it from one location to another while the armature is held in one position by the permanent magnet. It also produces smooth, mechanical action when actuated by an electrical impulse. The actuator of the present invention provides a construction which minimizes the expense of manufacture and assembly and gives precise, uniform and reliable performance.

SUMMARY OF THE INVENTION

It is a general object of the present invention to provide an improved electromagnetic actuator. Specifically, it is an object of this invention to provide an electromagnetic actuator including an armature linkage which moves between two predetermined positions in response to either a force applied manually or to the forces resulting from the application of an electrical impulse.

It is another object to provide an electromagnetic actuator which quietly produces mechanical action and which does not wear out prematurely.

Other objects, advantages and features of the present invention will become apparent upon reading the following detailed description and appended claims and upon reference to the accompanying drawings.

In accordance with one embodiment of this invention, an electromagnetic actuator which achieves the foregoing object includes a housing comprising a cylinder of highly magnetically permeable material, closed at one end by a highly magnetically permeable wall member. The housing contains a permanent magnet mounted to the first wall member and axially aligned with the housing. The housing also contains an axially aligned and magnetically permeable core which is magnetically coupled with the permanent magnet and which supports an actuator coil.

A shunt wafer of highly magnetically permeable material disposed in close magnetic coupling relation with the permanent magnet at one end of the core forms a gap with the inner wall of the housing. This gap completes a flux circuit of predetermined maximum reluctance for maintaining the magnetization of the permanent magnet. This circuit includes the permanent magnet, the shunt wafer, the gap, the housing cylinder, and the magnetically permeable end wall. An annular member of magnetically impermeable material lies at the end of the core opposite the end which supports the shunt wafer and forms a gap between the core and a pole piece. The pole piece is highly magnetically permeable, and it contacts the inner wall of the housing.

A movable armature, when disposed in a first position, magnetically bridges the gap formed by the member which separates the pole piece and the core. In this position, the armature completes a low reluctance magnetic circuit including the core, the armature, the pole piece, the housing cylinder, the first end wall, and the permanent magnet. This magnetic circuit effectively magnetically shorts the gap between the housing and the shunt wafer and promotes maximum flux flow since it does not include materials of low magnetic permeability.

Upon application of a current pulse of appropriate amplitude and direction, the coil produces a magnetic field which reduces the flux flow through the armature and, accordingly, the magnetic force upon the armature. This allows a compression spring disposed in the opening which extends through the core to overcome the remaining magnetic force thereon and, thus, to move the armature to a second position.

To move the armature back to the first position, the user may manually overcome the force of the compression spring, using a linkage which transmits the mechanical action of the armature, and move the armature back into the first position. The user may also apply a current pulse of appropriate amplitude and direction to the coil to overcome the force of the spring and move the armature to the first position.

The linkage includes a rod of magnetically impermeable material which extends through the actuator in a manner which allows unrestrained axial movement of the rod. In addition, the linkage includes a stop on the rod which the armature engages to force the linkage in one direction when moving from the first to the second position. The rod also is free to move relative to the armature in that one direction. The linkage further includes a sleeve of highly magnetically permeable material secured to the rod. This sleeve allows the permanent magnet to bias the linkage so that the stop of the linkage constantly abuts the armature. This feature prevents "hammering" between the armature and the linkage.

When the user manually advances linkage from the first to the second predetermined locations, the permanent magnet maintains the armature in the first location and the linkage slides past the armature.

BRIEF DESCRIPTION OF THE DRAWINGS

For a more complete understanding of this invention one should now refer to the embodiment illustrated in greater detail in the accompanying drawings and described below by way of an example of the invention. In the drawings.

While the drawings and the following text describe the invention in connection with a preferred embodiment, one will understand, of course, that the invention is not limited to this embodiment. Furthermore, one should understand that the drawings are not necessarily to scale.

DETAILED DESCRIPTION OF THE DRAWINGS AND THE PREFERRED EMBODIMENT

Figure 1:
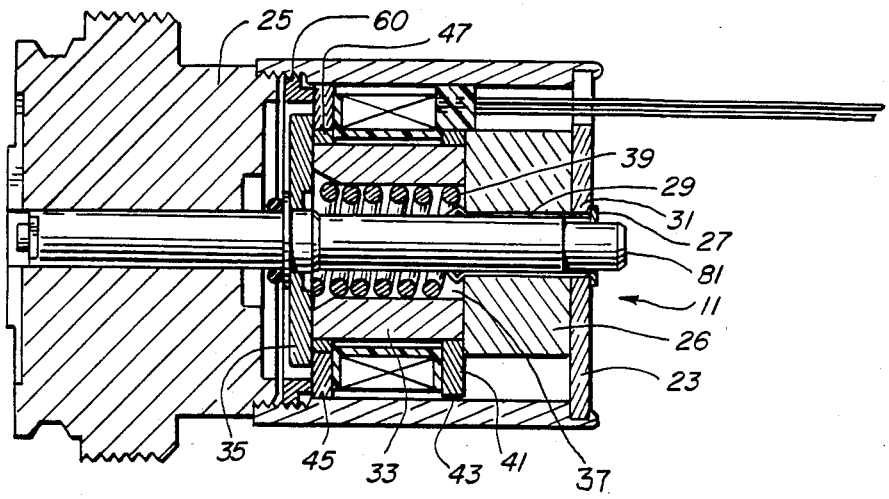
FIG. 1 is a sectional view of a preferred embodiment of a bi-stable electromagnetic actuator of the present invention, showing the armature in a first stable position.

Turning now to the drawings, FIG. 1 shows the preferred embodiment of a bi-stable electromagnetic actuator generally at 11. The actuator includes a housing 13 comprising a substantially cylindrical member 21, closed at one end by a wall member 23 and at the other end by a wall and mounting member 25. The cylinder 21 and the wall member 23 are made from highly magnetically permeable materials. The wall and mounting member 25 may be of any structurally suitable material, including material of low magnetic permeability. In the preferred embodiment, the wall and mounting member 25 is a metal of low magnetic permeability.

Any suitable connecting means may secure the wall member 23 and the mounting member 25 to the cylinder 21. The preferred embodiment includes a conventional threaded type connection between the wall and mounting member 25 and the cylinder 21. It also shows wall member 23 staked to the cylinder 21. In the case of wall member 23, however, the connection used must maintain close magnetic contact (low reluctance) between the cylinder 21 and the wall member 23.

Wall member 23 supports a permanent magnet 26 which has an annular shape and a high magnetic remanence. A tubular bearing insert 27 which extends through the inner opening 29 of the permanent magnet 26 and an opening 31 in the wall member 23 secures the wall member and the permanent magnet 26 together and maintains close magnetic contact between the two members.

The actuator 11 also includes a core 33 disposed in the housing 13 in magnetically coupled contact with the permanent magnet 26. This core is a highly magnetically permeable material, and it transmits magnetic flux which provides the magnetic force required to maintain the actuator's armature 35 in a first position against the opposite end of the core, as shown in FIG. 1. The core 33 has an annular shape with an inner opening 37 which contains a compression spring 39 confined under compression between the permanent magnet 26 and the armature 35. Under the circumstances described below, this spring 39 forces the armature 36 to the second stable position shown in FIG. 2.

A shunt wafer 41 disposed around the core 33 contacts the magnet 26 and forms a nonworking gap 43 with the inner surface of the cylinders 21. The permanent magnet 26, the shunt wafer 41, the gap 43, the cylinder 21 and the end wall 23 form a first magnetic circuit of a predetermined maximum reluctance for preserving at least a minimum level of magnetization of the permanent magnet 26.

To complete the magnetic circuit which transmits flux to restrain the armature 35 in the first position (FIG. 1), the actuator 11 includes two concentric rings, including an outer ring 45 and an inner ring 47. The outer ring 45 is a pole piece of highly magnetically permeable material, and it contacts the inner surface of the cylinder 21. The inner ring 47 is a magnetically impermeable material and it forms a "working gap." In the preferred embodiment, this ring 47 is a nonmagnetic stainless steel or brass. However, various other materials, including air, may provide the same function, i.e. to form a magnetically impermeable gap.

For ease of assembly and effective operation, rings 45 and 47 and the core 33 form a one-piece unit. Using appropriate connecting means, the maker of the actuator 11 may fixedly secure ring 47 to the core piece 33 and the pole piece 45 to the ring 47. This allows the maker to grind coplanar the outer surfaces 51, 53 and 55 of the pole piece 45, the magnetically impermeable ring 47 and the core 33, respectively, to allow the armature 35 to effectively engage these members.

The armature 35 is an annular plate-like member of high magnetic permeability which engages the core 33, the magnetically impermeable ring 47 and the pole piece 45 at surfaces 51, 53 and 55 and bridges the ring 47 to complete a second magnetic circuit. The flux in this magnetic circuit moves from the permanent magnet 26 through the core 33, the armature plate 35, the pole piece 45, the cylinder 21 and the end wall 23 and back to the permanent magnet 26. This flux generates a magnetic force sufficient to maintain the armature plate 35 in a first position shown in FIG. 1 against the force of the compression spring 39.

To selectively reduce the magnetic flux and accordingly the magnetic force restraining the armature 35, the actuator includes a coil 57 which, upon application thereto of an appropriate electrical pulse, produces a magnetic force to counteract the force produced by the permanent magnet. A plastic bobbin 59 disposed around the core 33 supports the coil between the shunt wafer 41 and the rings 45 and 47. An annular ring 60 threaded into the inner wall of the cylinder 21 clamps the bobbin 59 and the shunt wafer 41 between the permanent magnet 26 and the rings 45 and 47; and it secures all of those components and the core 33 in the housing 13.

When the coil 57 receives an electric pulse in the appropriate direction it reduces the net flow of the flux through the armature 35. The magnetic force on the armature plate, accordingly, becomes less than the force supplied by the spring 39, and the spring expands to move the armature 35 to the second position shown in FIG. 2. When moving from the first to the second position, the armature plate engages a retractable linkage pin 61 and forces it to move in the same direction. It will be appreciated that the pin 61 may be connected to other mechanical components for driving or to be driven by the pin in the operation of the actuator 11.

Figure 4:
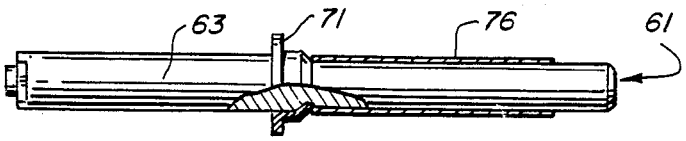
FIG. 4 is a partially cutaway view of the armature linkage used in the electromagnetic actuator of the present invention.

Referring now to FIG. 4, the linkage pin 61 includes a rod 63 of magnetically impermeable material which extends through the actuator along the longitudinal axis of the actuator housing. It extends through an appropriately sized opening 65 in end wall 25, through an opening 67 in the center of armature 35, through the middle of the compression spring, and through the tubular insert 27. These openings allow unrestrained axial movement of the rod. The length of the rod is greater than the length of the actuator housing 13. Thus, a portion of the rod 63 extends outside of the actuator housing where the user may grasp the end of the rod and manipulate the linkage.

The linkage 61 also includes a stop 71 which the armature 35 engages for driving the linkage when moving from the first to the second stable positions. This stop is a shoulder bushing secured to the rod 63 by press fitting and/or swaging into an annular groove around the rod 63.

An O-ring 75 disposed around the rod 63 adjacent the stop 71 serves as a bumper and engages the end wall member 25 before the armature 35 contacts the wall 25. In doing so, the ring 75 absorbs the impact which would otherwise occur between the armature and the wall 25. The O-ring 75 may be any elastic material, e.g. rubber.

Figure 3:
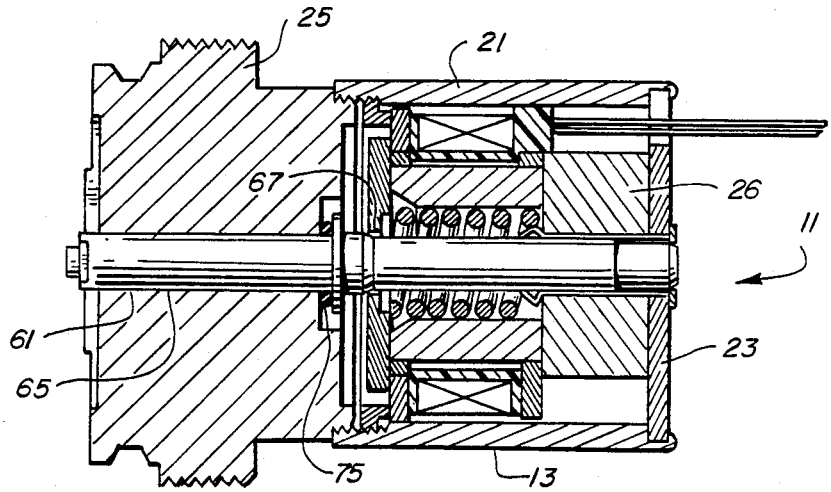
FIG. 3 is a sectional view showing the armature in the first stable position and the linkage in the second or retracted position.

The linkage 61 is not fixed to the armature and is free to be moved to the second position as in FIG. 3, independently of the armature. This permits deliberate manual movement of the linkage pin and attached apparatus, such as for testing a system to which the actuator is connected for automatic or alarm actuation upon occurrence of a condition which generates an appropriate pulse in coil 57. However, if the linkage pin 61 is in the position of FIG. 3 when the armature is released and driven by the spring, to the left in the drawings, hammering contact would occur between the armature 35 and the stop 71. For example, such relative pre-positioning will tend to occur due to the weight of the pin if the actuator is mounted with end 25 downward.

Figure 2:
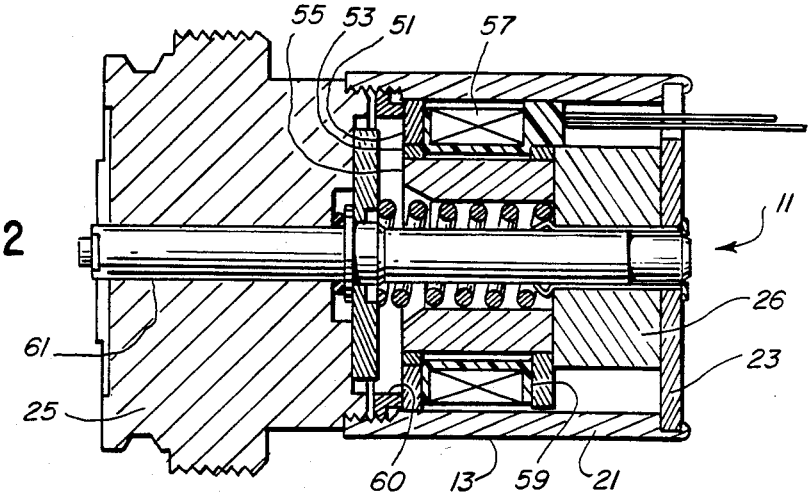
FIG. 2 is the sectional view similar to FIG. 1 showing the armature in a second stable position after actuation of the actuator coil and extension of the actuator's compression spring.

In order to normally retain the linkage pin in the inward position and in abutment with stop 71, as in FIG. 2, and thereby assure simultaneous movement of the pin and armature when the armature is driven by the spring, the linkage 61 also includes a thin sleeve 76 made of soft magnetic material. The sleeve 76 is disposed around and fixedly secured to the rod 63 at the end proximate the permanent magnet 26, and it lies within the magnetic field created by the permanent magnet 26. It allows the permanent magnet to pull the linkage in the direction of the permanent magnet 26 and the stop 71 in abutting relation with the armature 35. This reduces any "hammering" action between the armature 35 and the stop 71, thus avoiding related damage of the parts and minimizing the production of metallic debris within the actuator, without adversely influencing the normal operation of the actuator.

Rather than actuating the coil and allowing the compression spring 39 to advance the armature from the first to the second position as shown in FIG. 2, the user may advance the linkage 61 merely by pressing the end 81 of the rod 63 into the actuator housing 13 to advance the linkage 61 to the position shown in FIG. 3. Thus, the linkage 61 is movable apart from the armature, and allows the user to manually operate the actuator.

Thus, a bistable electric magnetic actuator has been provided which meets the aforestated objects. The actuator provides a linkage which transmits the mechanical action of the actuator armature and which is movable apart from the armature. The actuator has a simplified construction which produces smooth mechanical action without any hammering between internal parts.

While the preceding text and the drawings illustrate one preferred embodiment, one should understand of course that the invention is not limited to this embodiment. Those skilled in the art to which the invention pertains may make modifications and other embodiments employing the principles of this invention, particularly upon considering the foregoing teachings. Therefore, by the appended claims, it is intended to cover any such modifications and other embodiments as incorporate those features which constitute the essential features of this invention.

What is claimed is:

1. A bi-stable electromagnetic actuator comprising: a housing; an armature disposed in said housing and being moveable between first and second predetermined positions; a retractable linkage member disposed in said housing in sliding engagement with said armature, said linkage member including a portion which projects out of said housing to allow manual advancement of said linkage between said first and second locations and a stop which the armature engages to move said linkage from said first to said second position; magnetic means for retaining said armature in said first stable position; coil means for reducing the net flux through said armature; advancing means for advancing said armature from said first to said second stable positions when said coil means reduces the net flux through said armature; and a biasing member secured to said linkage, said biasing member disposed within the magnetic field of said magnetic means to bias said linkage and maintain said linkage in abutting relation with said armature.

2. The bi-stable electromagnetic actuator device of claim 1, wherein said armature is a highly magnetically permeable plate member having an opening therethrough for receiving the linkage member.

3. The bi-stable actuator device of claim 2, wherein said linkage includes a rod made of magnetically impermeable material.

4. The bi-stable electromagnetic actuator device of claim 1, wherein said biasing member is a thin sleeve of soft magnetic material.

5. The bi-stable electromagnetic actuator device of claim 1, further comprising bumper means disposed in said housing for absorbing the impact when said linkage and armature stop at the second position.

6. An improved bi-stable electromagnetic actuator having a housing, magnetic means for retaining an armature in a first position, advancing means for advancing said armature to a second position, and coil means for reducing the retaining force provided by said magnetic means to allow said advancing means to advance said armature, wherein the improvement comprises: an armature disposed in said housing and being moveable between first and second predetermined positions; a retractable linkage member disposed in said housing in sliding engagement with said armature, said linkage member including a portion which projects out of said housing to allow manual advancement of said linkage between said first and second locations, and a stop which the armature engages to move said linkage from said first to said second position; and a biasing member secured to said linkage, said biasing member disposed within the magnetic field of said magnetic means to bias said linkage and maintain said linkage in abutting relation with said armature.

* * * * *